US005538200A

United States Patent [19]

Tatum

[11] Patent Number: 5,538,200

[45] Date of Patent: Jul. 23, 1996

[54] APPARATUS FOR COMPACTING AND ROLLING SHEET MATERIAL FOR CUTTING AND PRODUCING WALL PAPER BORDERS OR THE LIKE

[75] Inventor: Paul C. Tatum, Autaugaville, Ala.

[73] Assignee: Dorothy L. Tatum, Elmore, Ala.

[21] Appl. No.: 347,239

[22] Filed: Nov. 23, 1994

[51] Int. Cl.[6] ..... B65H 18/04

[52] U.S. Cl. ..... 242/532.5; 242/538; 242/548.2; 242/578.3; 242/586.4; 242/598.2; 242/599.3

[58] Field of Search ..... 242/532.5, 586.4, 242/538, 538.1, 538.2, 548.2, 578.3, 599.3, 599.2, 598.2

[56] References Cited

U.S. PATENT DOCUMENTS

| | | | |
|---|---|---|---|
| 473,411 | 4/1892 | Allen | 242/598.2 X |
| 484,173 | 10/1892 | Brown . | |
| 602,253 | 4/1898 | Brady . | |
| 810,606 | 1/1906 | Ball | 242/598.2 |
| 1,073,946 | 9/1913 | Bain . | |
| 1,675,863 | 7/1928 | Parsons | 242/598.2 X |
| 2,592,090 | 4/1952 | Weaver . | |
| 3,132,820 | 5/1964 | Toll . | |
| 3,637,154 | 1/1972 | Northup | 242/538 X |
| 3,899,142 | 8/1975 | Hodges et al. | 242/538 |
| 3,981,509 | 9/1976 | Myer | 242/599.2 X |
| 4,106,715 | 8/1978 | Pisani | 242/538 X |
| 4,709,869 | 12/1987 | Candler | 242/538 X |
| 4,781,336 | 11/1988 | Rosenthal et al. . | |
| 5,271,137 | 12/1993 | Schutz | 242/533.7 X |

*Primary Examiner*—John M. Jillions
*Attorney, Agent, or Firm*—John C. Garvin, Jr.; Harold W. Hilton

[57] ABSTRACT

Apparatus and method for winding sheet material for producing a rewound roll having a smaller central hollow core and a more compact configuration. The material is wound so that a first edge of each layer of the roll terminates in the same plane. By compacting the wound sheet material and providing a smaller central bore, the sheet material is made sufficiently rigid so that it may be cut transversely thereacross adjacent and edge thereof without further compressing the material into the hollow core.

9 Claims, 4 Drawing Sheets

APPARATUS FOR COMPACTING AND ROLLING SHEET MATERIAL FOR CUTTING AND PRODUCING WALL PAPER BORDERS OR THE LIKE

FIELD OF THE INVENTION

This invention is directed to an apparatus and method for rolling sheet material so that the material may be then cut in a straight line while in a rolled configuration. More particularly, the invention relates to such apparatus and method for producing wall paper borders from a roll of wall paper.

BACKGROUND OF THE INVENTION

Typically, rolled material, such as wall paper, has a relatively large hollow core and the plies (layers) of material are loosely wound around the hollow core. If one attempted to cut transversely across and in relatively close proximity of an edge of the material while it is in a rolled configuration, the end edges to be cut would be compressed inwardly toward the hollow core and a cut across the roll adjacent the edge being cut would not produce a straight line after the material is uncompressed and unrolled.

There are many devices available which are utilized to cut sheet materials while the sheet material is being rolled between two rollers. U.S. Pat. No. 602,253 issued to J. M. Brady on Apr. 12, 1898, for example, is directed to a machine for trimming wall paper. The machine is a hand operated machine which unrolls a roll of material from a first roller onto a second roller. The material is fed between a pair of cutters so that the cutters may trim the edges of the material during movement of the sheet material from the first roller to the second roller. Such trimming function requires that the wall paper be moved relatively slowly through the cutters so that the edge being cut can be engaged by the cutters along the entire length of the edge surfaces as the paper is linearly moved through the cutters.

Other devices which relate to sheet material cutting machines are disclosed in U.S. Pat. No. 484,173 entitled "Machine For Slitting And Winding Paper", issued to A. P. Brown on Oct. 11, 1892; and, U.S. Pat. No. 473,411 entitled "Machine For Trimming Wall Paper", issued to A. Allen on Apr. 18, 1892. None of the above mentioned patents disclose apparatus and method for rolling wallpaper in a manner which is suitable for being cut into borders while the wall paper is in a rolled configuration.

Some other patents which disclose the function of winding sheet materials in a roll are U.S. Pat. Nos. 3,132,820; 4,781,336; 2,592,090; and 1,073,946.

DESCRIPTION OF THE PREFERRED EMBODIMENT

Figure 1:
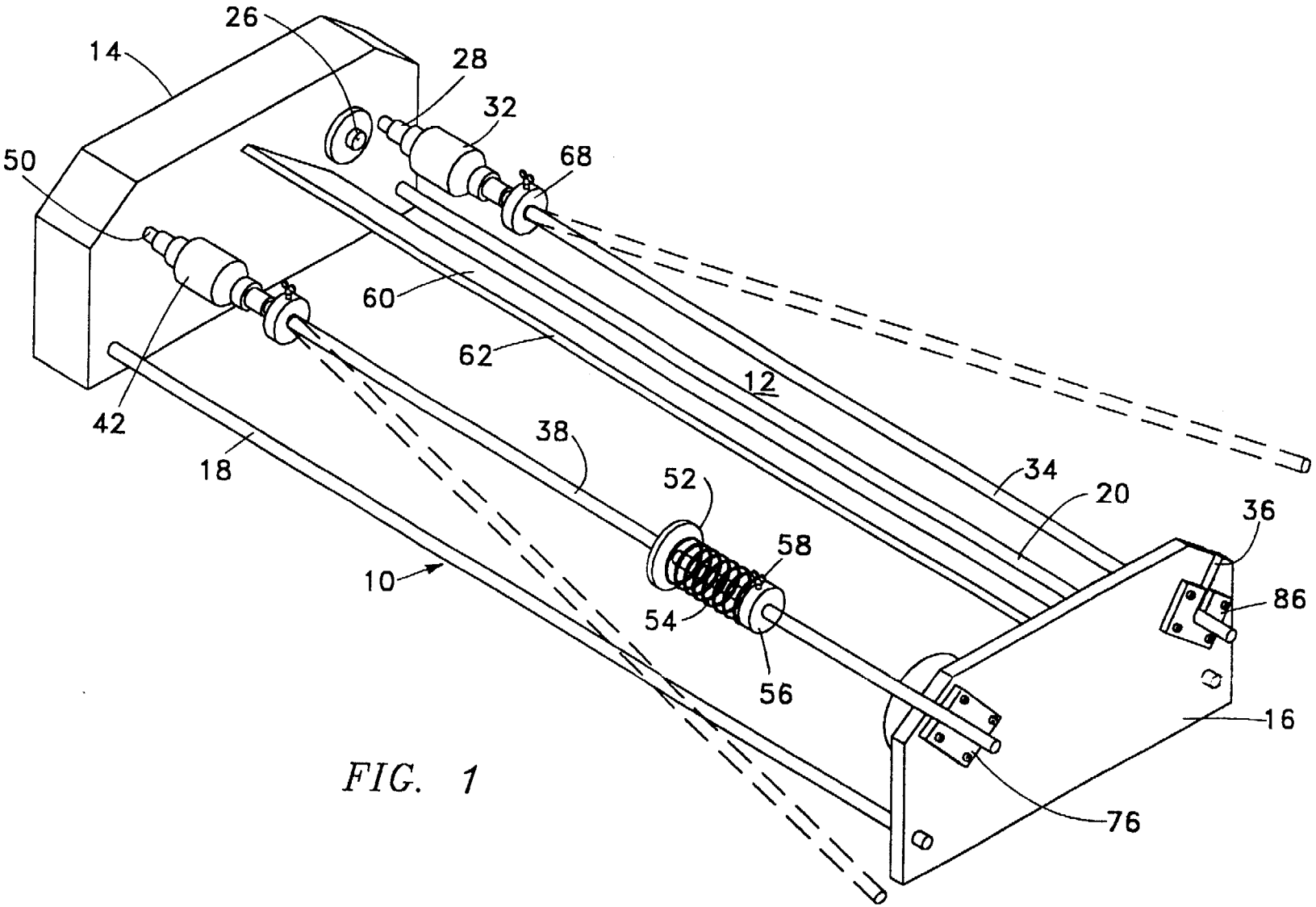
FIG. 1 is a pictorial view of the device of the present invention.

As seen in FIG. 1, the sheet material rolling machine 10 includes a frame 12 having an end motor housing portion 14, end member 16 and a pair of rods 18 and 20 secured between member 16 and end portion 14.

End portion 14 forms a housing for a variable speed electric motor 22 (FIG. 2) and a motor control assembly 24 which includes a knob 26 for rotation thereof to control the speed of motor 22.

A stub shaft 28 extends from motor 22 into one end 30 (FIG. 2) of a flexible coupling 32. A material winding shaft 34 has one end mounted in coupling 32 and the shaft 34 extends therefrom to be removably supported in a slotted opening 36 in end member 16.

A second shaft 38 is provided for support of the roughly wound material. Shaft 38 includes an end 40 (FIG. 2) which extends and is secured in a flexible coupling 42 (which is similar to coupling 32) at one end 44 thereof. The second end 46 of shaft 38 is removable supported in a slotted opening 48 of end plate 16. A stub shaft 50 extends from coupling 42 and is supported in end portion 14.

Figure 5:
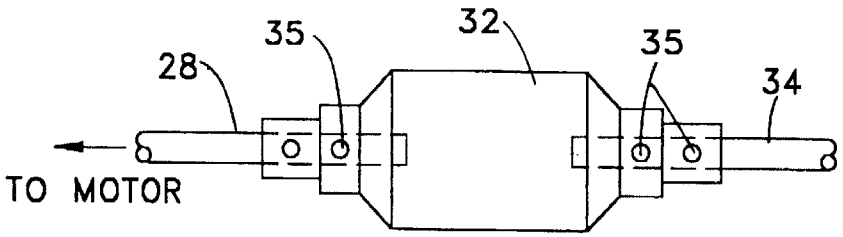
FIG. 5 is an enlarged view of the shaft coupling devices of FIGS. 1, 2 and 3.
Figure 6:
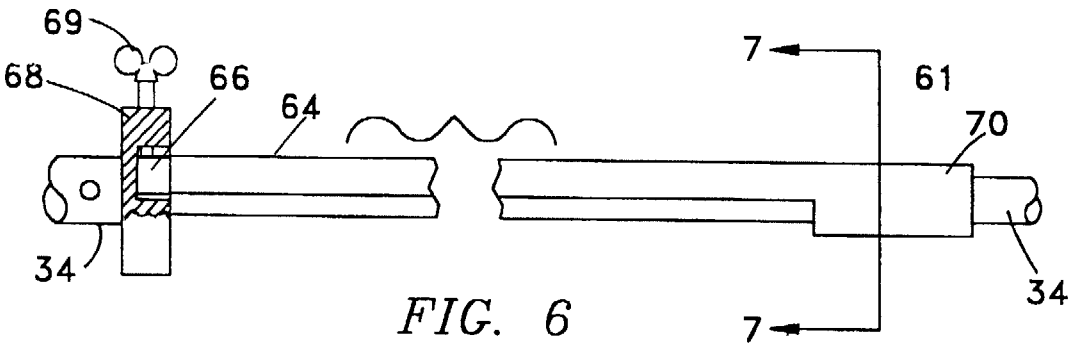
FIG. 6 is an elevational view illustrating the motor operated shaft of FIG. 1 which supports the free end of the roll of material which is to be wound. A removable clamping member is shown for clamping the material between the motor operated shaft and the clamping member so that the material may be releasably secured to the shaft.

Couplings 32 and 42 are shown to be of elastomeric material and permit shafts 34 and 38 to be pivoted upwardly and outwardly as shown in FIG. 1. The shafts are secured in the couplings by set screws 35 as shown in FIG. 5. In its outward position (as shown by the dash lines in FIG. 1) a roll of roughly wound material may be positioned on shaft 38. After positioning the roll on shaft 38, a flange 52 is placed adjacent the end of the roll. A spring 54 is slid on shaft 38 in abutting relation with flange 52 and a collar 56 is placed against the spring and tightened by a wing screw 58 against shaft 38 to retain the roll in biased relation against the flange 52.

Figure 7:
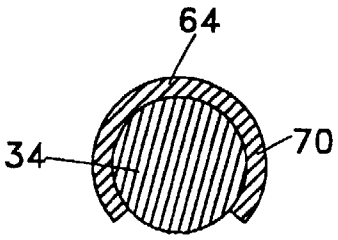
FIG. 7 is a sectional view along line 7—7 of FIG. 6 illustrating the clamping member in clamped relation with the motor operated shaft.
Figure 8:
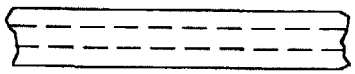
FIG. 8 is a partial elevational view of the end of a roll of material before it is rolled on the device of the present invention.
Figure 9:
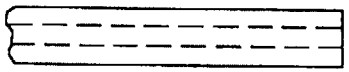
FIG. 9 is a partial elevational view of the end of a roll of material after it is rolled on the device of the present invention.
Figure 10:
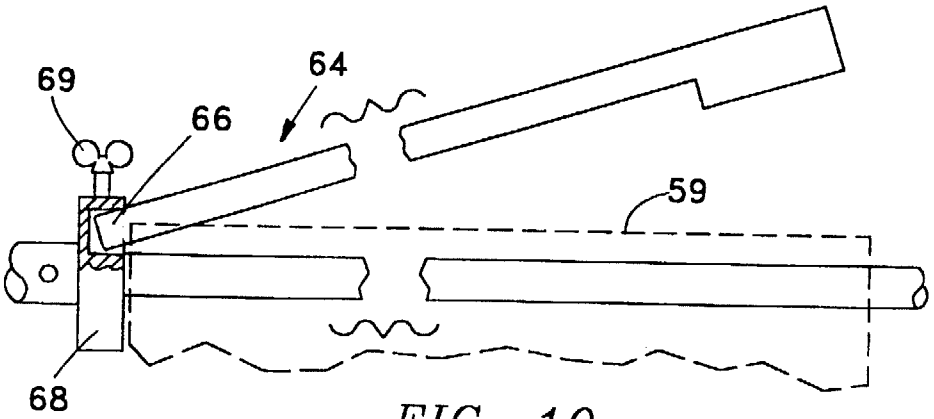
FIG. 10 is an elevational view of the motor shaft having the material to be rolled positioned thereon with the clamping member being removably positioned on the shaft for clamping the material to the motor shaft.

The distal end 59 (FIG. 2) of the roll is then unwound and placed over a support plate 60 having a rounded front surface 62. The free or distal end of the material is further "pulled out" or unrolled from shaft 38 to engage shaft 34 to which it (the distal end) is clamped by a clamping member 64. The clamping member 64 is an elongated semi-annular (in cross-section) member (FIG. 7) and includes a first end 66 (FIG. 10) which is placed under a collar 68 prior to collar 68 being secured to shaft 34 by a wing screw 69 and a second end 61 which includes an "over center" portion 70 which is bendable (having a spring action) or flexible enough to fit over shaft 34 and (under pressure from one's finger) clamp itself thereto. Once the distal end 59 of the material is positioned on shaft 34 and clamped thereto by clamping member 64, the roll of material is transferred from shaft 46 and rolled on shaft 34 and clamping member 64 because of the rotation of shaft 34 by motor 22. The rod 34 is then pivoted upwardly and outwardly (as shown by the dash lines in FIG. 1) and then the clamping member is removed by unclamping collar 68 and sliding the clamping member from the newly created smaller core opening. The newly rolled material is then slid off of the shaft and placed in an appropriate cutter (FIG. 12) to be cut while in a rolled configuration.

A tamping plate 73 is shown to be secured to end member 16 to provide a convenient surface against which the end (cut edge) of the material may be tamped to assure that the cut surface of each layer is in the same plane.

Figure 2:
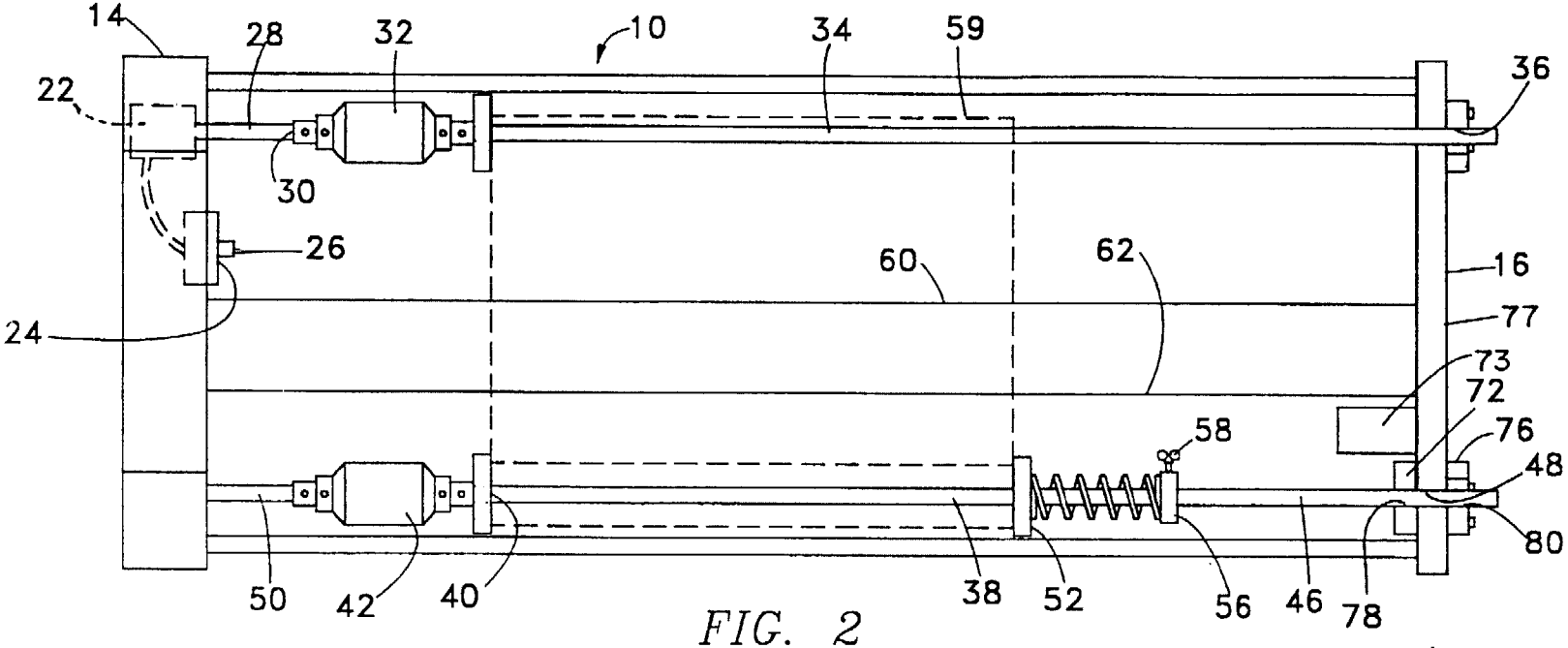
FIG. 2 is a plan view of the device of FIG. 1.
Figure 3:
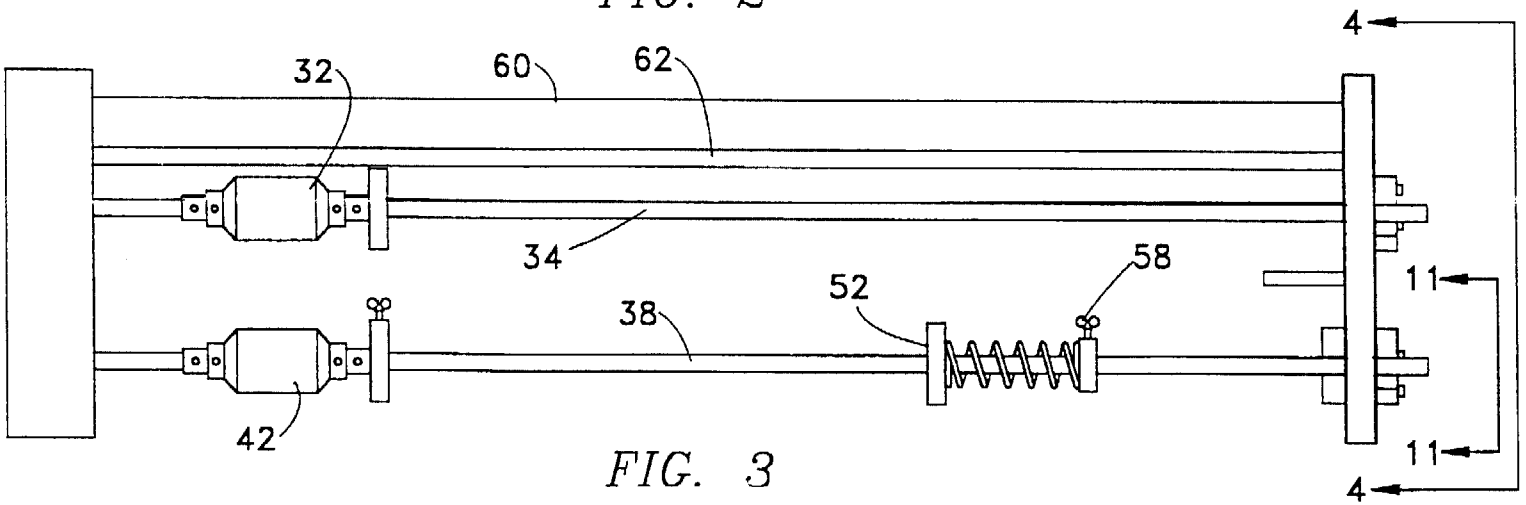
FIG. 3 is a front elevational view of the device of FIG. 1.
Figure 4:
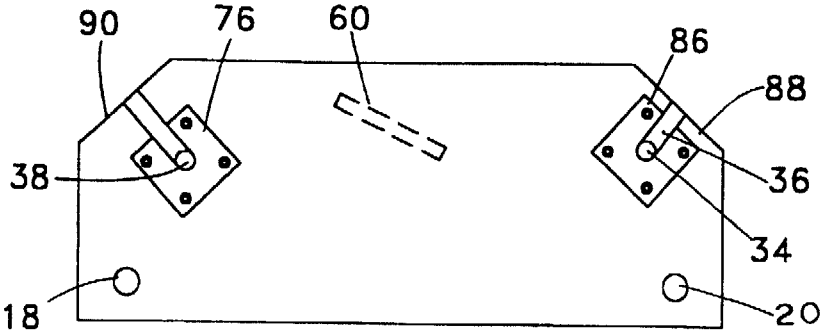
FIG. 4 is an end elevational view as seen along line 4—4 of FIG. 3.
Figure 11:
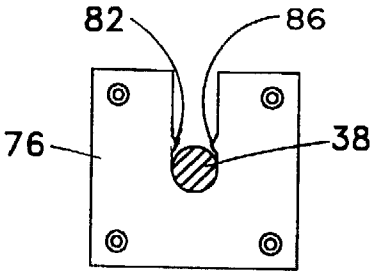
FIG. 11 is a view taken along line 11—11 of FIG. 3.

As is seen in FIGS. 2, 3 and 4, an end shaft support member 73 is provided on the interior surface 74 of end member 16 and a locking support member 76 (preferably Nylon or Teflon or the like) is provided on the outer surface 77 of end support member 16. Support member 72 is provided with a slot 78 therein which is positioned adjacent to and in alignment with slot 48 of end member 16. Locking support member 76 is provided with a slot 80 which is positioned adjacent to and in alignment with slot 48 of end member 16. As seen in FIG. 11, locking support member 76 is provided with a pair of inwardly projecting shoulders 82 and 84 which are sufficiently flexible enough to allow the shaft to be pushed downwardly between them but is rigid enough to retain the shaft below the shoulders once the shaft is positioned in the slot. Under a slight upward pressure the shaft may be moved upwardly through the space between the shoulders in order to pivot the shaft upwardly to a position wherein the roll of material may be placed on or removed from the shaft. In like manner, a second shaft support member 86 is provided to support and retain the distal end of the motor driven shaft 34 in end support member. Shaft support member 86 is similar in construction to shaft support member 76. It should be noted that the slots 36 and 48 are disposed in normal relation to angled surfaces 88 and 90 of end plate 16. The surfaces are angled at angles in the range of 45 degrees–60 degrees to enable the shafts to be moved upwardly and outwardly from the machine frame.

Figure 12:
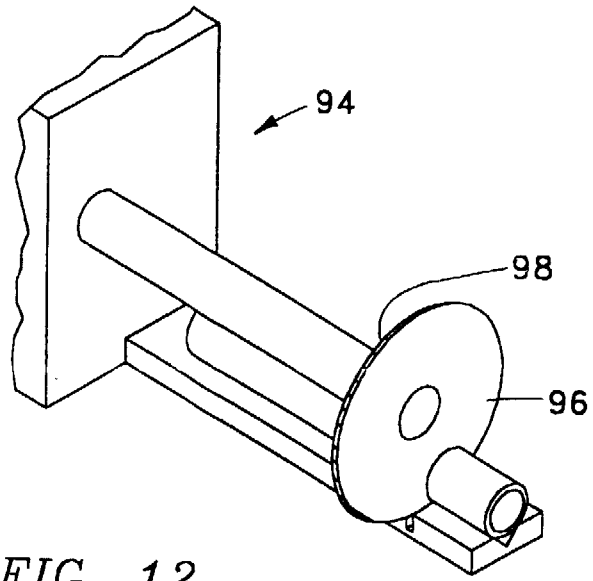
FIG. 12 is a pictorial view of the compacted roll of material in a circular saw for cutting the border material.

FIG. 12 is a pictorial view of a compacted roll of wall paper positioned in a circular saw 94. The saw is shown to have a blade 96 having teeth 98 disposed thereon which enables the saw to cut transversely across the compacted roll of wall paper. The saw may be a typical miter saw having blades provided with the edges disposed in predetermined angled relation which permits the roll of paper to be cut without shredding the edge.

It is to be understood that collar 68 may, if desired, form a second guide means for the roll of sheet material in which case one edge of the sheet material may engage collar 68 on shaft 34 and the second edge of the sheet material will engage the inner surface of flange 52 as discussed, supra.

Figure 13:
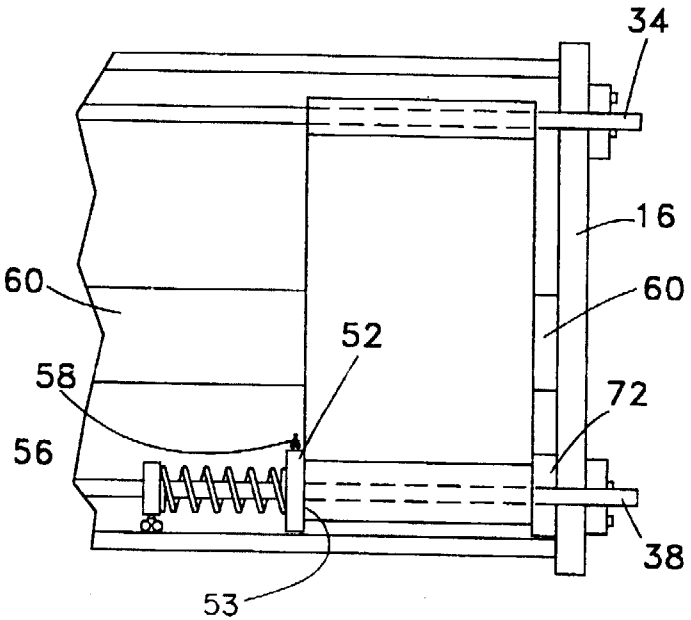
FIG. 13 is a plan view of the machine of FIGS. 1, 2 and 3 illustrating the rerolling of the sheet material after it has been cut.

FIG. 13 is a plan view of the machine of FIGS. 1, 2 and 3 shown rerolling the wall paper after it has been cut into borders, if desired. Typically, during the initial rolling process, as decided above, the design surface (surface having the designs thereon) is wound with the design facing inwardly. To rewind the border material or that the design faces outwardly, the position of the flange 52, and collar are reversed as shown in FIG. 13. In position the edges of the cut border material is guided between the inner surface 53 of flange 52 and the inner surface of member 72.

I claim:

1. A machine for winding a roll of wall paper for producing a roll of wall paper borders wherein a first edge of each layer of said roll of wall paper borders terminates in a substantially common plane to permit cutting of said roll of wall paper borders while said roll of wall paper borders is in a rolled configuration to produce a second edge which is substantially parallel to said first edge, said machine comprising:

a frame having first and second end supports disposed in spaced relation and means for securing said first and second end supports in said spaced relation;

a first rotatable driven shaft assembly mounted between said first and second end supports, said first rotatable driven shaft assembly having a pair of pivotally secured sections;

a variable speed electric motor for rotating said first shaft assembly;

a second shaft assembly mounted between said first and second supports in spaced relation with said first shaft, said second shaft assembly having a pair of pivotally secured shaft sections, said second shaft assembly disposed for supporting said roll of wall paper thereon, said roll of wall paper having a distal end disposed for unwinding from the said vicinity of said second shaft assembly and for secured relation on said first rotatable shaft assembly for rotation therewith, whereby said roll of wall paper is unwound from said second shaft assembly onto said first shaft assembly; and first and second shaft support and retention means provided on said first support means of said frame for supporting and retaining the respective distal ends of a first of said shaft sections thereon during the operation of said machine; and coupling means for securing said pair of shaft sections of each said shaft assembly in pivotal relation, said coupling means comprising an elastomeric member having a pair of end sections, each end section provided with an opening to respectively receive an end of said pair of shaft sections therein.

2. A machine as in claim 1 wherein each said pair of pivotally secured sections of each said shaft assembly is comprised of a stub shaft coupled to a second elongated shaft by said coupling means, said elongated shaft having a distal end for insertion into said support and retention means.

3. A machine as in claim 2 including an elongated sheet material support member secured to said first and second end supports, said sheet material support member being positioned above and intermediate said first and second shaft assemblies for support of said sheet material intermediate the ends thereof.

4. A machine as in claim 3 including guide and roll retention means movably mounted on said second shaft assembly in biased relation with a first edge of said roll of sheet material.

5. A machine as in claim 4 wherein said guide and roll retention means includes a flange having first and second surfaces, said first surface disposed for engaged relation with said first edge of said roll of sheet material, a spring disposed in abutting relation with second surface of said flange, a collar disposed in abutting relation with said spring, and, securing means for securing said collar to said shaft.

6. A machine as in claim 1 including securing means for the secured relation of said distal end of said wall paper on said second shaft assembly, said securing means comprising an elongated member having first and second ends and a substantially semi-annular cross-sectional configuration, and a collar disposed for slidably secured relation on said shaft, said first end of said elongated member disposed for insertion between said second shaft and said collar for secured relation to said second shaft, said second end of said elongated member having a semi-annular cross configuration defining an over center arrangement which is disposed for engaged relation around said second shaft.

7. Apparatus for preparing a roll of wall paper for cutting into wall paper borders having parallel side edges while said wall paper is in a rolled configuration, said wall paper having a free end and a central hollow core having a substantially enlarged diameter, said apparatus comprising:

a frame having first and second spaced end sections and support means extending between said first and second end sections;

a first shaft assembly extending between and supported in said end sections of said frame, said first shaft assembly including first and second sections disposed in pivotally secured relation, said first section having a first end extending into said first end section of said frame and a second distal end;

a second shaft assembly disposed in spaced relation with said first shaft assembly for support of said roll of wall paper thereon, said second shaft assembly including first and second sections disposed in pivotally secured relation, said first section having a first end extending into said first end section of said frame and a second distal end;

first shaft securing means for pivotally securing said first and second shaft sections of said first shaft assembly, said first shaft securing means being a flexible member having first and second open ends to respectively receive said distal end of said first section of said first shaft assembly and said first end of second section of said first shaft assembly in secured relation therein;

second shaft securing means for pivotally securing said first and second sections of said second shaft assembly, said second shaft securing means being a flexible member having first and second open ends to respectively receive said distal end of said first section of said second shaft assembly and said first end of said second section of said second shaft assembly in secured relation therein;

means mounted in said first end section of said frame and attached to said first section of said first shaft assembly for rotating said first shaft assembly; and means for securing said free end of said wall paper roll to said first shaft assembly, whereby said roll of wall paper is wound on said first shaft assembly with a smaller core diameter than said enlarged diameter to provide a more compact roll of wall paper suitable for being cut transversely thereacross while in a rolled configuration.

8. Apparatus as in claim 7 wherein said second end section of said frame includes an upper surface having first and second slots therein, said slots extending downwardly from said upper surface of said second end section of said frame, said first slot disposed for receiving and supporting said second end of said second section of said first shaft therein, said second slot disposed for receiving and supporting said second end of said second section of said second shaft therein.

9. A machine for winding sheet material for producing a roll of material wherein a first edge of each layer of said roll terminates in a substantially common plane to permit cutting of said material while said material is in a rolled configuration to produce a second edge which is substantially parallel to said first edge, said machine comprising:

a frame having first and second end supports disposed in spaced relation and means for securing said first and second end supports in said spaced relation;

a first rotatable driven shaft assembly mounted between said first and second end supports, said first rotatable driven shaft assembly having a pair of pivotally secured sections;

means for rotating said first shaft assembly;

a second shaft assembly mounted between said first and second supports in spaced relation with said first shaft, said second shaft having a pair of pivotally secured shaft sections, said second shaft assembly disposed for supporting said roll of sheet material thereon, said roll of sheet material having a distal end disposed for unwinding from the said vicinity of said second shaft assembly and for secured relation on said first rotatable shaft assembly for rotation therewith, whereby said sheet material is unwound from said second shaft assembly onto said first shaft assembly; and first and second shaft support and retention means provided on said first support means of said frame for supporting and retaining the respective distal ends of a first of said shaft sections thereon during the operation of said machine; and coupling means for securing said pair of shaft sections of each said shaft assembly in pivotal relation, said coupling means comprising an elastomeric member having a pair of end sections, each end section provided with an opening to respectively receive an end of said pair of shaft sections therein.

* * * * *